US010930232B2

(12) United States Patent
Zeng

(10) Patent No.: US 10,930,232 B2
(45) Date of Patent: Feb. 23, 2021

(54) METHOD FOR COLOR SHIFT COMPENSATION BASED ON ABNORMAL IMAGE DETECTION

(71) Applicants: HKC Corporation Limited, Shenzhen (CN); Chongqing HKC Optoelectronics Technology Co., ltd., Chongqing (CN)

(72) Inventor: Dekang Zeng, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 136 days.

(21) Appl. No.: 16/338,515

(22) PCT Filed: Jul. 3, 2017

(86) PCT No.: PCT/CN2017/091520
§ 371 (c)(1),
(2) Date: Apr. 1, 2019

(87) PCT Pub. No.: WO2018/113244
PCT Pub. Date: Jun. 28, 2018

(65) Prior Publication Data

US 2020/0043428 A1 Feb. 6, 2020

(30) Foreign Application Priority Data

Dec. 23, 2016 (CN) ..... 201611205822.9

(51) Int. Cl.
*G09G 3/36* (2006.01)

(52) U.S. Cl.
CPC ..... *G09G 3/3607* (2013.01); *G09G 2320/029* (2013.01); *G09G 2320/0242* (2013.01); *G09G 2320/0666* (2013.01)

(58) Field of Classification Search
None
See application file for complete search history.

(56) References Cited

U.S. PATENT DOCUMENTS

2011/0037790 A1* 2/2011 Onishi ..... G09G 3/342 345/690
2013/0207940 A1* 8/2013 Song ..... G09G 3/20 345/204

(Continued)

*Primary Examiner* — Benjamin C Lee
*Assistant Examiner* — Emily J Frank
(74) *Attorney, Agent, or Firm* — WPAT, PC

(57) ABSTRACT

The present application discloses a method for color shift compensation based on an abnormal image detection and a display device, including storing inputted n numbers of sub-pixel values in a row storage space; judging every spaced two of the sub-pixel values whether are the same or not; initiating a color shift compensation if the spaced two of the sub-pixel values being different; judging every adjacent two of the sub-pixel values whether are different if every spaced two of the sub-pixel values are the same; judging every one of the sub-pixel values in a current row storage space whether is different from a sub-pixel value in a previous row storage space corresponding to the sub-pixel value in the current row storage space; doing not initiate a color shift compensation if every one of the sub-pixel values in the current row storage space is different from that in the previous row.

7 Claims, 7 Drawing Sheets

(56) References Cited

U.S. PATENT DOCUMENTS

| | | | | |
|---|---|---|---|---|
| 2014/0028739 | A1* | 1/2014 | Takahashi | G09G 3/3648 345/690 |
| 2014/0098143 | A1* | 4/2014 | Lee | G09G 3/2092 345/690 |
| 2016/0314733 | A1* | 10/2016 | Crounse | G09G 3/2003 |
| 2017/0352317 | A1* | 12/2017 | Huang | G02F 1/134309 |

* cited by examiner

| | | | | | | |
|---|---|---|---|---|---|---|
| adr1' | adr2' | adr3' | adr4' | ..... | adr(n-1)' | adm' |
| adr1 | adr2 | adr3 | adr4 | ..... | adr(n-1) | adm |

METHOD FOR COLOR SHIFT COMPENSATION BASED ON ABNORMAL IMAGE DETECTION

FIELD OF THE INVENTION

The present application relates to an electrical technology field, and more particularly to a method for color shift compensation based on an abnormal image detection and a display device.

BACKGROUND OF THE INVENTION

Nowadays, display panels are widely used in electronic products such as digital watches, televisions and portable computers including liquid crystal display panels, OLED display panels, etc., a certain color shift phenomenon is usually presented in the general display panel during use. For example, the current liquid crystal display panel is mainly based on thin film transistor liquid crystal display panel, referred to as TFT-LCD, the TFT liquid crystal display panel is an active matrix liquid crystal display panel, each of its liquid crystal display pixels are driven by the thin film transistor integrated in the backside, so that the image information can be displayed in high-speed, high-brightness, high-contrast. Each pixel of the TFT liquid crystal display panel is provided with a semiconductor switch, each pixel can be directly controlled by the point pulse, so each node is relatively independent, and can be continuously controlled. The color filter in the framework TFT pixels can be divided into three according to the color of red (R), green (G), blue (B), and arranged in the glass substrate to form a row in an order, each of the single color filter in one of the pixel is called sub-pixel. The TFT liquid crystal display includes a panel of a tri-gate structure, the panel can be divided into a plurality of display areas, each display areas corresponding to a plurality of rows and columns of memory spaces, the memory spaces are for corresponding storing the sub-pixel value of the sub-pixel.

It is needed to perform the centralized wiring processing in the lamination region of the driving integrated circuit, and then output to the display line during the design of the TFT liquid crystal display panel in the pixel display matrix design. If the sub-pixels on each display line are charged at the same time, the voltage on both sides of the lines will be seriously delay than the intermediate voltage, so that the charging time on each display line is inconsistent, that is, the sub-pixels in the display line cannot reach the desired potential at the same time. In the display process of the mixing color image of the TFT liquid crystal display panel, both sides will appear serious color shift problem to the performance of reddish, greenish or bluish. At present, for the color shift problem, the color shift compensation (CSC) algorithm is mainly used to compensate the display data on both sides of the liquid crystal display, so that both sides show the color and the middle display color to achieve the same effect. However, due to the structure design of the TFT liquid crystal display panel, in some cases, if the display screen is performed with some functional compensation (such as CSC compensation, etc.), it is easily prone to noise, making the screen display even worse.

SUMMARY OF THE INVENTION

The present application provides a method for color shift compensation based on an abnormal image detection and a display device, the issue of producing noise caused by the color shift compensation can be avoided, improve the display quality of the display image, enhance the user's experience.

In order to achieve the above object, in one aspect, an embodiment of the present application provides a method for color shift compensation based on an abnormal image detection, the method including:

Storing inputted n numbers of sub-pixel values one by one in a row storage space, wherein n is an integer greater than or equal to four;

Judging every spaced two of the sub-pixel values whether are the same or not;

Initiating a color shift compensation if there is the spaced two of the sub-pixel values being different from each other;

Judging every adjacent two of the sub-pixel values whether are different from each other if every spaced two of the sub-pixel values are the same;

Judging every one of the sub-pixel values in a current row storage space whether is different from a sub-pixel value in a previous row storage space corresponding to the sub-pixel value in the current row storage space if every adjacent two of the sub-pixel values are different from each other; and Not initiating a color shift compensation if every one of the sub-pixel values in the current row storage space is different from the sub-pixel value in the previous row storage space corresponding to the sub-pixel value in the current row storage space.

In order to achieve the above object, another aspect of the present application provides a display device including:

A display panel;

A storage unit, configured for storing program instructions;

A processing unit, connected to the display panel and the storage unit and configured for invoking and executing the program instructions to perform steps of:

Storing inputted n numbers of sub-pixel values one by one in a row storage space, wherein n is an integer greater than or equal to four;

Judging every spaced two of the sub-pixel values whether are the same or not;

Initiating a color shift compensation if there is the spaced two of the sub-pixel values being different from each other;

Judging every adjacent two of the sub-pixel values whether are different from each other if every spaced two of the sub-pixel values are the same;

Judging every one of the sub-pixel values in a current row storage space whether is different from a sub-pixel value in a previous row storage space corresponding to the sub-pixel value in the current row storage space if every adjacent two of the sub-pixel values are different from each other; and Not initiating a color shift compensation if every one of the sub-pixel values in the current row storage space is different from the sub-pixel value in the previous row storage space corresponding to the sub-pixel value in the current row storage space.

In order to achieve the above object, another aspect of the present application provides a display device including:

A display panel; and

A storage unit, configured for storing inputted n numbers of sub-pixel values one by one in a row storage space, wherein n is an integer greater than or equal to four;

A first judgment unit, configured for judging every spaced two of the sub-pixel values whether are the same or not;

A first processing unit, configured for initiating a color shift compensation if there is the spaced two of the sub-pixel values being different from each other;

A second judgment unit, configured for judging every adjacent two of the sub-pixel values whether are different from each other if every spaced two of the sub-pixel values are the same;

A third judgment unit, configured for judging every one of the sub-pixel values in a current row storage space whether is different from a sub-pixel value in a previous row storage space corresponding to the sub-pixel value in the current row storage space if every adjacent two of the sub-pixel values are different from each other; and A second processing unit, configured for doing not initiate a color shift compensation if every one of the sub-pixel values in the current row storage space is different from the sub-pixel value in the previous row storage space corresponding to the sub-pixel value in the current row storage space.

In the embodiment of the present invention, it is possible to determine a display image that does not require color shift compensation during the process of performing color shift compensation on the display image so as to avoid occurrence of noise due to color shift compensation, improve the display quality of the display image, and enhance the user's experience.

BRIEF DESCRIPTION OF THE DRAWINGS

In order to more clearly illustrate the embodiments of the present application or prior art, the following FIG.s will be described in the embodiments are briefly introduced. It is obvious that the drawings are merely some embodiments of the present application, those of ordinary skill in this field can obtain other FIG.s according to these FIGs without paying the premise.

DETAILED DESCRIPTION OF PREFERRED EMBODIMENTS

Embodiments of the present application are described in detail with the technical matters, structural features, achieved objects, and effects with reference to the accompanying drawings as follows. It is clear that the described embodiments are part of embodiments of the present application, but not all embodiments. Based on the embodiments of the present application, all other embodiments to those of ordinary skill in the premise of no creative efforts acquired should be considered within the scope of protection of the present application.

It is to be understood that the terms "comprising" and "consisting" when referring to the specification and the appended claims indicate the presence of the features, integers, steps, operations, elements and/or components described but do not exclude one or the presence or addition of a number of other features, integers, steps, operations, elements, components and/or collections thereof.

It is also to be understood that the terminology used herein in this specification is for the purpose of describing particular embodiments only and is not intended to be limiting of the present application. As used in this specification and the appended claims, the singular forms "a", "an" and "the" are intended to include the plural forms unless the context clearly dictates otherwise. It should also be further understood that the term "and/or" as used in the specification and the appended claims refers to any combination of one or more of the items listed in association and all possible combinations and includes those combinations.

At present, people mainly use color shift compensation (CSC) algorithm on both sides of the LCD display data to compensate, so that both sides of the display color and the middle display color to achieve the same effect. Wherein the color shift compensation means that, the voltage value applied to the target sub-pixel can be adjusted to the standard voltage value in real time, so as to change the displayed color of the target sub-pixel display, so as to solve the color shift problem of the liquid crystal display panel due to the difference resistance and to improve the display performance. At the same time, in order to avoid noise point by the use of color shift compensation when detecting no image, use the following method need to be used to adjust accordingly. Wherein, no image includes sub-pixel bright and dark image, sub-pixel bright and dark image is sub-pixel on/off image.

Figure 1:
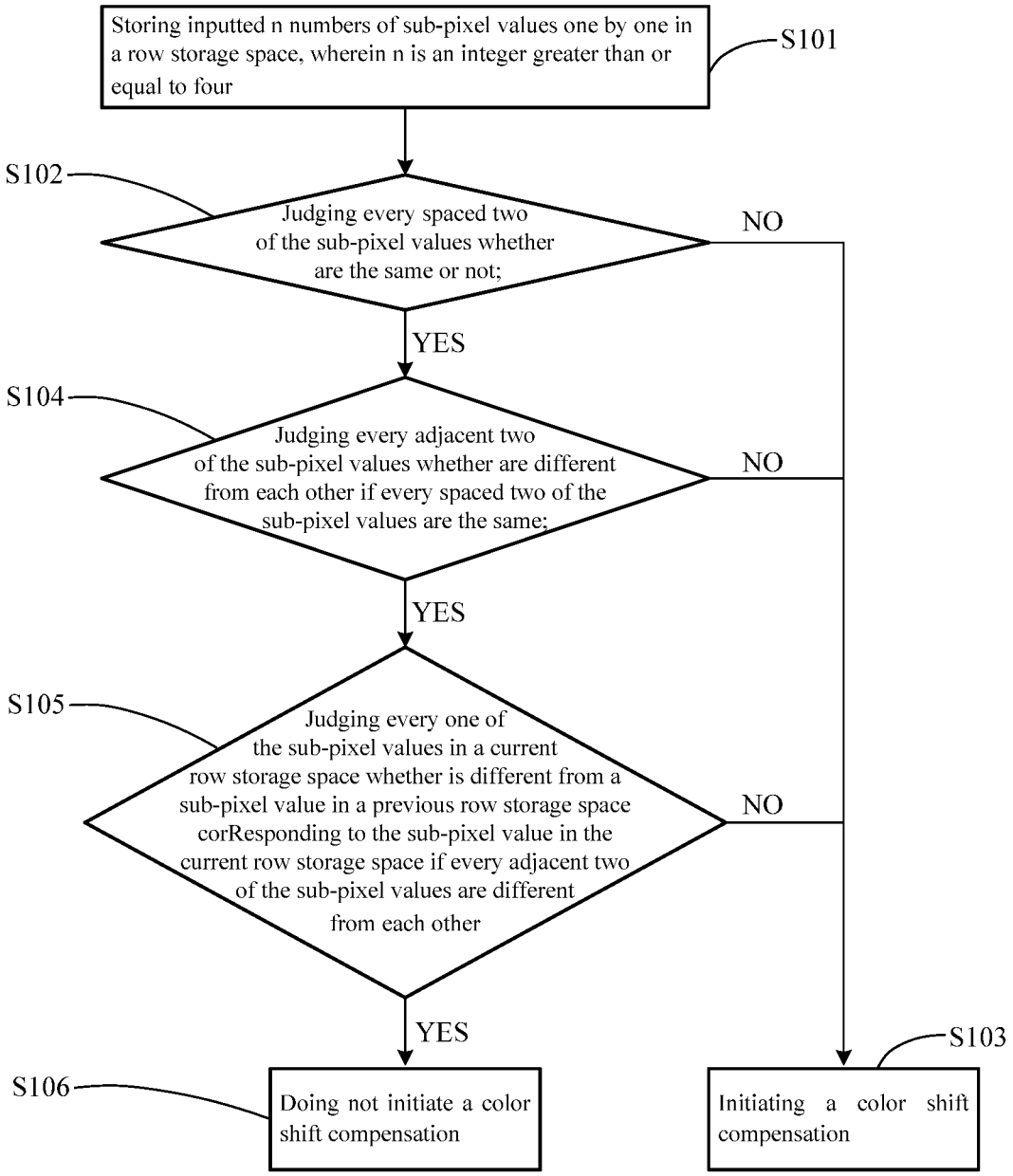
FIG. 1 is a schematic flow diagram of method for color shift compensation based on an abnormal image detection provided by an embodiment of the present application.

Referring to FIG. 1, FIG. 1 is a schematic flow diagram of method for color shift compensation based on an abnormal image detection provided by an embodiment of the present application, the method as shown in the FIG. include the following steps of:

Step S101, storing inputted n numbers of sub-pixel values one by one in a row storage space, wherein n is an integer greater than or equal to four.

Wherein, taking TFT liquid crystal display as an example, the TFT pixel structures of the TFT liquid crystal display refers to the color filter is divided into three types: red (R), green (G), blue (B) according to the color, and is arranged sequentially in the glass substrate to form a row, each of the single color filter in one of the pixel is called sub-pixel. The input values of n sub-pixels are stored sequentially in the order of one by one in the pixel buffer by the lined up form, the pixel buffer including a plurality of rows of storage space, each row of storage space can be arranged in parallel up and down, each row of storage space corresponds to the corresponding registered address. Of course, the color of the color filter can also be divided into a variety of other colors according to the actual situation.

Figures 2A, 2B:
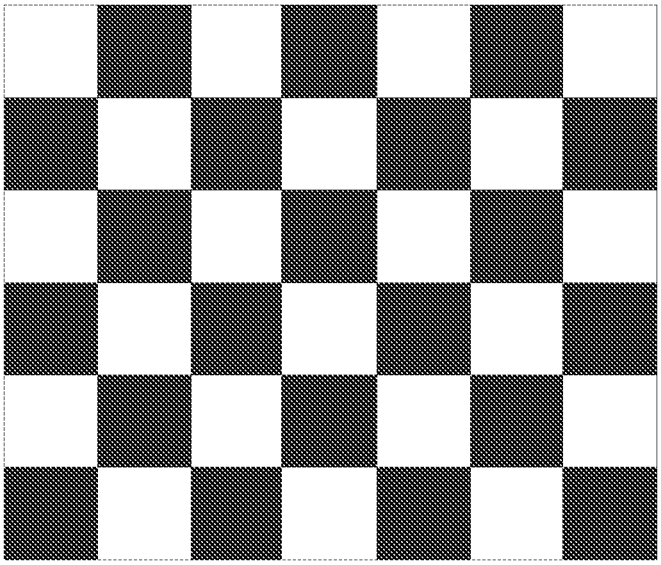
FIG. 2*a* is bright and dark image of a sub-pixel.
FIG. 2*b* is the registered address of the row storage space.

Referring to FIG. 2*a*, for a bright and dark image of the sub-pixel, each row in the figure represents sub-pixels, one small block in each row represents a sub-pixel, each sub-pixel corresponds to a sub-pixel value, each pixel value is stored sequentially in order to the address corresponding to the address of the row storage space. The white in the figure indicates that the sub-pixel is bright, and the black indicates that the sub-pixel is dark, that is, under normal circumstances, the sub-pixels are only dark and bright.

Referring to FIG. 2*b*, is the registered address of the row storage space, wherein the address 1 (Adr1), address 2 (adr2), address 3 (adr3), address 4 (adr4), . . . address (n−1) (adr (n−1)) and the address n (adrn) in the row storage space is corresponding to store a sub-pixel value, wherein n is an integer greater than or equal to four.

Step S102, judging every spaced two of the sub-pixel values whether are the same or not.

For example, it can be judged that the two sub-pixel values corresponding to adr1 and adr3, the two sub-pixel values corresponding to adr2 and adr4, the two sub-pixel values corresponding to adr3 and adr5, the two sub-pixel values corresponding to adr(n−1) and adr(n+1) and the two sub-pixel values corresponding to adrn and adr(n+2) are all equal or not.

Step S103, initiating a color shift compensation if there is the spaced two of the sub-pixel values being different from each other.

Wherein, as long as the spaced two sub-pixel values are different, it is indicated that the image displayed by the TFT liquid crystal display is not sub-pixel bright and dark image, that is, in the situation of having an image, so in order to avoid color shift in this time, it need to initiate color shift compensation. Specifically, it can be the different values of the two sub-pixels corresponding to adr1 and adr3, it can be the different values of the two sub-pixels corresponding to adrn and adr (n+2), but also these two situations exist simultaneously; it can be all the every spaced two of the sub-pixel values are different from each other.

Step S104, judging every adjacent two of the sub-pixel values whether are different from each other if every spaced two of the sub-pixel values are the same.

Wherein, when all of the spaced two sub-pixel values are the same, that is the two sub-pixel values correspond to adr1 and adr3 are the same, the two sub-pixel values correspond to adr2 and adr4 are the same, two sub-pixel values correspond to adr3 and adr5 are the same, . . . the two sub-pixel values correspond to adr(n−1) and adr(n+1) are the same, and the two sub-pixel values correspond to adrn and adr(n+2) are the same, it is judged that every adjacent two of the sub-pixel values are different.

Step S105, judging every one of the sub-pixel values in a current row storage space whether is different from a sub-pixel value in a previous row storage space corresponding to the sub-pixel value in the current row storage space if every adjacent two of the sub-pixel values are different from each other.

Wherein, if the two sub-pixel values corresponding to adr1 and adr2 are different, the two sub-pixel values corresponding to adr2 and adr3 are different, the two sub-pixel values corresponding to adr3 and adr4 are different, . . . the two sub-pixel values corresponding to adr(n−1) and adrn are different, the two sub-pixel values corresponding to adrn and adr(n+1) are different, then it can be judged every one of the sub-pixel values in the current row storage space whether is different from a sub-pixel value in the previous row storage space corresponding to the sub-pixel value in the current row storage space.

Alternatively, if each of the two adjacent sub-pixel values are the same, the process returns to step S103 to initiate the color shift compensation. Specifically, as long as the two sub-pixel values corresponding to adrn and adr (n+1) is the same, wherein n is any number of integers greater than or equal to 4, it is indicated that the image displayed by the TFT liquid crystal display is not sub-pixel bright and dark image, that is, in the situation of having an image, so in order to avoid color shift in this time, it need to initiate color shift compensation.

Step S106, not initiating a color shift compensation if every one of the sub-pixel values in the current row storage space is different from the sub-pixel value in the previous row storage space corresponding to the sub-pixel value in the current row storage space.

As shown in FIGS. 2*a* and 2*b*, if the two sub-pixel values corresponding to adr1 and adr1' are different, the two sub-pixel values corresponding to adr2 and adr2' are different, the two sub-pixel values corresponding to adr3 and adr3' are different . . . the two sub-pixel values corresponding to adrn and adrn' are different, it is indicated that the image displayed by the TFT liquid crystal display is sub-pixel bright and dark image, that is, in the situation of having no image, so in order to avoid producing noise and other negative effects after initiating the color shift compensation, the color shift compensation is need not to be initiated to improve the display quality of the display image, enhance the user's experience.

Alternatively, if all of each sub-pixel value in the current row storage space is the same with the corresponding sub-pixel value in the previous row storage space, the process returns to step S103 to initiate the color shift compensation. Wherein, as long as the two sub-pixel values corresponding to adrn and adrn' is the same, n is integer any number greater than or equal to 4, it is indicated that the image displayed by the TFT liquid crystal display is not sub-pixel bright and dark image, that is, in the situation of having an image, so in order to avoid color shift in this time, it need to initiate color shift compensation.

Figure 3:
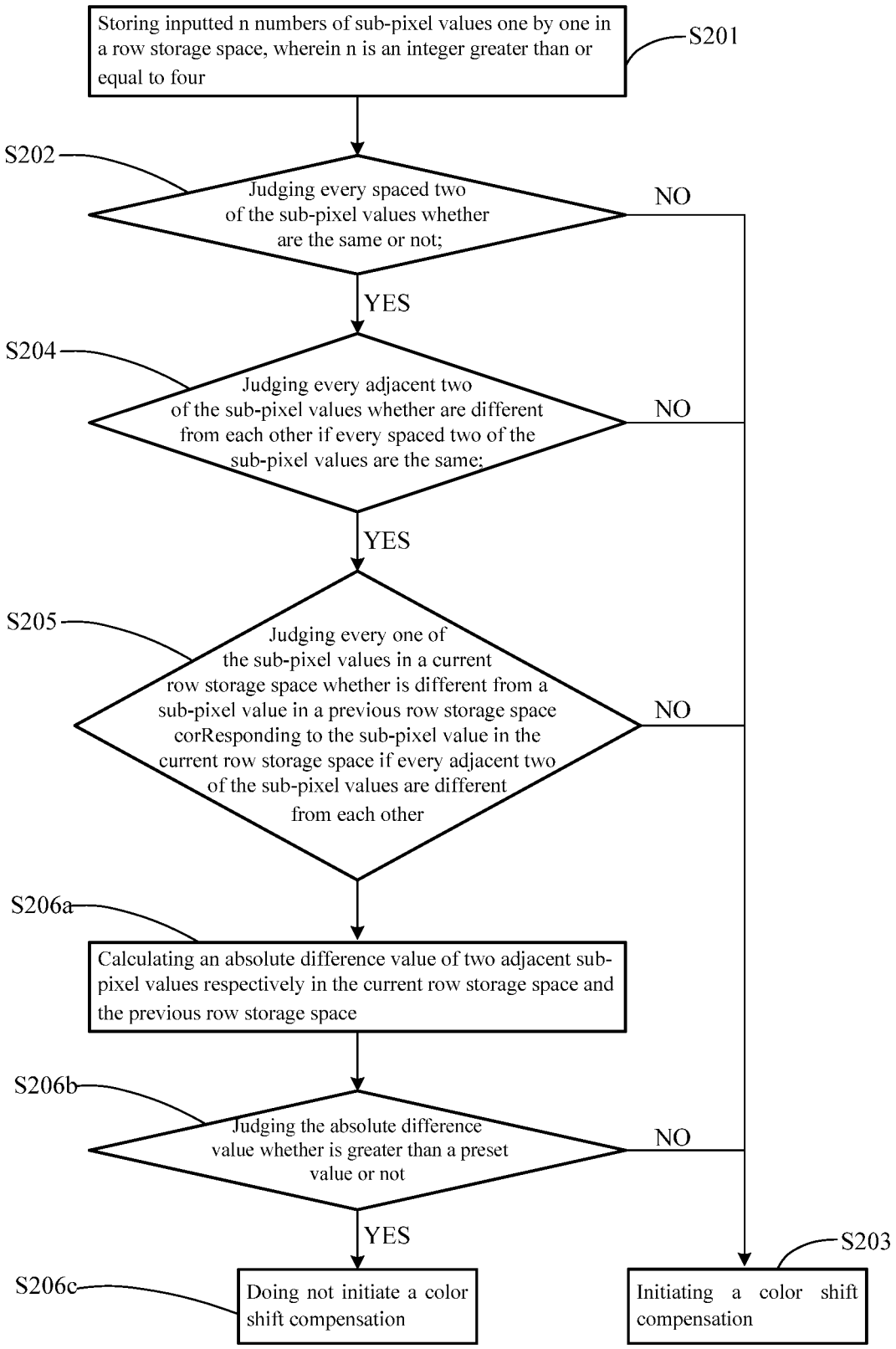
FIG. 3 is a schematic flow diagram of method for color shift compensation based on an abnormal image detection provided by another embodiment of the present application.

Referring to FIG. 3, FIG. 3 is a schematic flow diagram of method for color shift compensation based on an abnormal image detection provided by another embodiment of the present application, the method as shown in the figure can include the following steps of:

Step S201, storing inputted n numbers of sub-pixel values one by one in a row storage space, wherein n is an integer greater than or equal to four;

Step S202, judging every spaced two of the sub-pixel values whether are the same or not;

Step S203, initiating a color shift compensation if there is the spaced two of the sub-pixel values being different from each other;

Step S204, judging every adjacent two of the sub-pixel values whether are different from each other if every spaced two of the sub-pixel values are the same;

Step S205, judging every one of the sub-pixel values in a current row storage space whether is different from a sub-pixel value in a previous row storage space corresponding to the sub-pixel value in the current row storage space if every adjacent two of the sub-pixel values are different from each other; and Step S206*a*, doing not initiate a color shift compensation if every one of the sub-pixel values in the current row storage space is different from the sub-pixel value in the previous row storage space corresponding to the sub-pixel value in the current row storage space, calculating an absolute difference value of two adjacent sub-pixel values respectively in the current row storage space and the previous row storage space.

Wherein, because even if each sub-pixel only has the two cases of dark and bright, however, during the operation of the TFT LCD, the real-time sub-pixel values of the two dark or two bright sub-pixels can be different.

It is necessary to compare two adjacent sub-pixel values when every one of the sub-pixel values in the current row storage space is different from the sub-pixel value in the previous row storage space corresponding to the sub-pixel value in the current row storage space, so that to more reasonable select whether to perform color shift compensation or not.

Step S206*b*, judging the absolute difference value whether is greater than a preset value or not.

If the two adjacent sub-pixels are dark, but at this time there is a difference between the two sub-pixel values, if the color shift compensation is performed directly, causing a noise is appeared in the display image, and affecting the user's viewing effect. So, a preset value can be set for a certain division, on a reasonable basis, choose whether to perform color shift compensation or not.

Step S206*c*, not initiating the color shift compensation if the absolute difference is greater than the preset value.

Wherein, if the absolute difference is greater than the preset value, it means that the difference between the two adjacent sub-pixel values is large, it can be identified as sub-pixel bright and dark image, that is, in the case of no image, it does not need to initiate color shift compensation, to avoid producing noise, improve the display quality of the display image, enhance the user's experience.

Alternatively, if the absolute difference is smaller than or equal to the preset value, the color shift compensation is initiated.

Wherein, if the absolute value is smaller than or equal to the preset value, it means that the difference between the two adjacent sub-pixel values is not large, it can be determined that is not the bright and dark image of a sub-pixel, that is, in the case of an image, the color shift compensation need to be initiated, in order to reduce the occurrence of color shift phenomenon, making the viewing experience of user to improved.

In addition, alternatively, if all of each sub-pixel values in the current row storage space are the same with the corresponding pixel value in the previous row storage space, the process returns to step S203 to initiate the color shift compensation.

Figure 4:
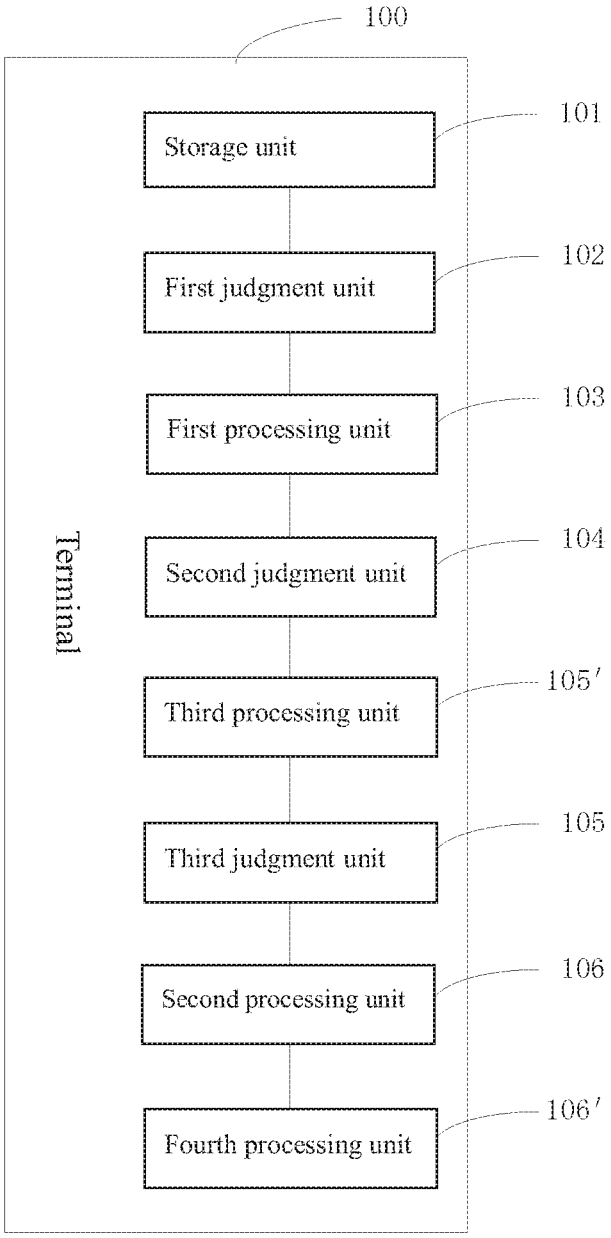
FIG. 4 is a schematic block diagram of a terminal provided by an embodiment of the present application.

Referring to FIG. 4, FIG. 4 is a schematic block diagram of a terminal provided by an embodiment of the present application, the terminal 100 as shown in the figure includes:

A storage unit 101 is configured for storing inputted n numbers of sub-pixel values one by one in a row storage space, wherein n is an integer greater than or equal to four;

Wherein, the TFT pixel structures of the TFT liquid crystal display refers to the color filter is divided into three types: red (R), green (G), blue (B) according to the color, and is arranged sequentially in the glass substrate to form a row, each of the single color filter in one of the pixel is called sub-pixel. The input values of n sub-pixels are stored sequentially in the order of one by one in the pixel buffer by the lined up form, the pixel buffer including a plurality of rows of storage space, each row of storage space can be arranged in parallel up and down, each row of storage space corresponds to the corresponding registered address. Of course, the color of the color filter can also be divided into a variety of other colors according to the actual situation.

Referring to FIG. 2*a*, for a bright and dark image of the sub-pixel, each row in the figure represents sub-pixels, one small block in each row represents a sub-pixel, each sub-pixel corresponds to a sub-pixel value, each pixel value is stored sequentially in order to the address corresponding to the address of the row storage space. The white in the figure indicates that the sub-pixel is bright, and the black indicates that the sub-pixel is dark, that is, under normal circumstances, the sub-pixels are only dark and bright.

Referring to FIG. 2*b*, is the registered address of the row storage space, wherein the address 1 (Adr1), address 2 (adr2), address 3 (adr3), address 4 (adr4), . . . address (n−1) (adr (n−1)) and the address n (adrn) in the row storage space is corresponding to store a sub-pixel value, wherein n is an integer greater than or equal to four.

A first judgment unit 102 is configured for judging every spaced two of the sub-pixel values whether are the same or not.

For example, it can be judged that the two sub-pixel values corresponding to adp1 and adr3, the two sub-pixel values corresponding to adp2 and adr4, the two sub-pixel values corresponding to adp3 and adr5, . . . the two sub-pixel values corresponding to adp(n−1) and adr(n+1) and the two sub-pixel values corresponding to adpn and adr(n+2) are all equal or not.

A first processing unit 103 is configured for initiating a color shift compensation if there is the spaced two of the sub-pixel values being different from each other;

Wherein, as long as the spaced two sub-pixel values are different, it is indicated that the image displayed by the TFT liquid crystal display is not sub-pixel bright and dark image, that is, in the situation of having an image, so in order to avoid color shift in this time, it need to initiate color shift compensation. Specifically, it can be the different values of the two sub-pixels corresponding to adr1 and adr3, it can be the different values of the two sub-pixels corresponding to adrn and adr (n+2), but also these two situations exist simultaneously, it can be all every spaced two sub-pixel values are different.

A second judging unit 104 is configured for judging every adjacent two of the sub-pixel values whether are different from each other if every spaced two of the sub-pixel values are the same.

Wherein, when all of the spaced two sub-pixel values are the same, that is the two sub-pixel values correspond to adr1 and adr3 are the same, the two sub-pixel values correspond to adr2 and adr4 are the same, two sub-pixel values correspond to adr3 and adr5 are the same, . . . the two sub-pixel values correspond to adr(n−1) and adr(n+1) are the same, and the two sub-pixel values correspond to adrn and adr(n+2) are the same, it is judged that every adjacent two of the sub-pixel values are different.

A third processing unit 105' is configured for initiating a color shift compensation if there are each two adjacent sub-pixel values is the same. Specifically, as long as the two sub-pixel values corresponding to adrn and adr (n+1) is the same, wherein n is any number of integers greater than or equal to 4, it is indicated that the image displayed by the TFT liquid crystal display is not sub-pixel bright and dark image, that is, in the situation of having an image, so in order to avoid color shift in this time, it need to initiate color shift compensation.

A third judging unit 105 is configured for judging every one of the sub-pixel values in a current row storage space whether is different from a sub-pixel value in a previous row storage space corresponding to the sub-pixel value in the current row storage space if every adjacent two of the sub-pixel values are different from each other.

Wherein, if the two sub-pixel values corresponding to adr1 and adr2 are different, the two sub-pixel values corresponding to adr2 and adr3 are different, the two sub-pixel values corresponding to adr3 and adr4 are different, . . . the two sub-pixel values corresponding to adr(n−1) and adrn are different, the two sub-pixel values corresponding to adrn and adr(n+1) are different, then it can be judged whether all of each sub-pixel value in the current row storage space is different from the sub-pixel value in the previous row storage space corresponding to the sub-pixel value in the current row storage space.

A second processing unit 106 is configured for not initiating a color shift compensation if every one of the sub-pixel values in the current row storage space is different from the sub-pixel value in the previous row storage space corresponding to the sub-pixel value in the current row storage space.

Wherein, as shown in FIG. 2*a*, if the two sub-pixel values corresponding to adr1 and adr1' are different, the two sub-pixel values corresponding to adr2 and adr2' are different, the two sub-pixel values corresponding to adr3 and adr3' are different, . . . the two sub-pixel values corresponding to adrn and adrn' are different, it is indicated that the image displayed by the TFT liquid crystal display is sub-pixel bright and dark image, that is, in the situation of having no image, so in order to avoid producing noise and other negative effects after initiating the color shift compensation, the color shift compensation is need not to be initiated to improve the display quality of the display image, enhance the user's experience.

A fourth processing unit 106' is configured for initiating the color shift compensation if there is the one of the sub-pixel values in the current row storage space being different from the sub-pixel value in the previous row storage space corresponding to the sub-pixel value in the current row storage space. Wherein, as long as there is adrn and adrn' corresponding to the two sub-pixel values of the same, n is greater than or equal to 4 integer any number, then the TFT LCD display is not sub-pixel bright and dark screen, that is, in the situation of having image, so this time in order to avoid color shift, it needs to initiate a color shift compensation.

Figure 5:
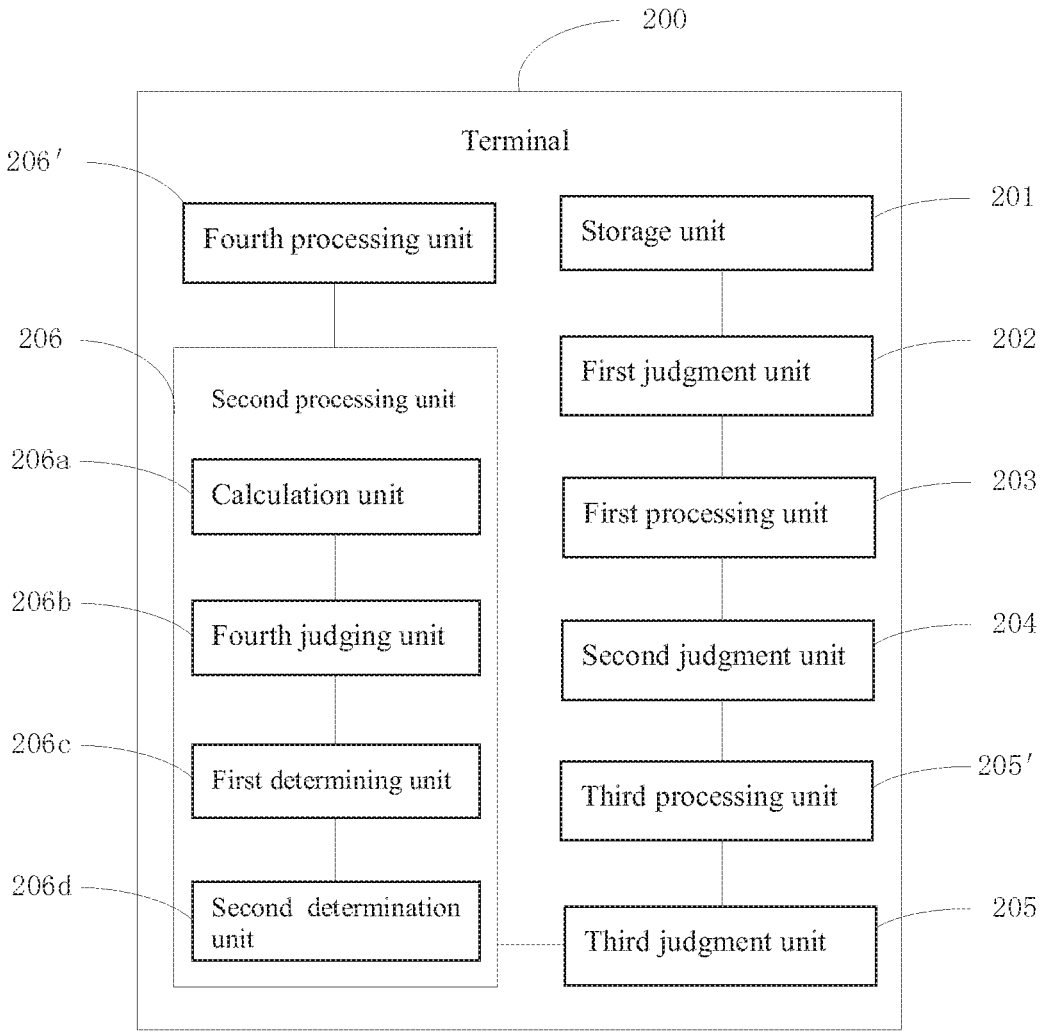
FIG. 5 is a schematic of a terminal provided by another embodiment of the present application.

Referring to FIG. 5, FIG. 5 is a schematic block diagram of a terminal provided by another embodiment of the present application, the terminal 200 as shown in the figure includes:

A storage unit 201 is configured for storing inputted n numbers of sub-pixel values one by one in a row storage space, wherein n is an integer greater than or equal to four.

A first judgment unit 202 is configured for judging every spaced two of the sub-pixel values whether are the same or not.

A first processing unit 203 is configured for initiating a color shift compensation if there is the spaced two of the sub-pixel values being different from each other.

A second judging unit 204 is configured for judging every adjacent two of the sub-pixel values whether are different from each other if every spaced two of the sub-pixel values are the same.

A third processing unit 205' is configured for initiating color shift compensation if every two adjacent sub-pixel values are the same.

A third judging unit 205 is configured for judging every one of the sub-pixel values in a current row storage space whether is different from a sub-pixel value in a previous row storage space corresponding to the sub-pixel value in the current row storage space if every adjacent two of the sub-pixel values are different from each other.

A calculation unit 206*a* is configured for calculating an absolute difference value of two adjacent sub-pixel values respectively in the current row storage space and the previous row storage space.

Wherein, because even if each sub-pixel only has the two cases of dark and bright, however, during the operation of the TFT LCD, the real-time sub-pixel values of the two dark or two bright sub-pixels can be different. It is necessary to compare two adjacent sub-pixel values when all of each sub-pixel value of the current row storage space is different from the sub-pixel value corresponding to each sub-pixel value in the previous row storage space, so that to more reasonable select whether to perform color shift compensation or not.

A fourth judging unit 206*b* is configured for judging the absolute difference value whether is greater than a preset value or not.

If the two adjacent sub-pixels are dark, but at this time there is a difference between the two sub-pixel values, if the color shift compensation is performed directly, causing a noise is appeared in the display image, and affecting the user's viewing effect. So, a preset value can be set for a certain division, on a reasonable basis, choose whether to perform color shift compensation or not.

A first determining unit 206*c* is configured for doing not initiate the color shift compensation if the absolute difference is greater than the preset value.

Wherein, if the absolute difference is greater than the preset value, it means that the difference between the two adjacent sub-pixel values is large, it can be identified as sub-pixel bright and dark image, that is, in the case of no image, it does not need to initiate color shift compensation, to avoid producing noise, improve the display quality of the display image, enhance the user's experience.

A second determination unit 206*d* is configured for initiating the color shift compensation if the absolute difference is smaller than or equal to the preset value. Wherein, if the absolute value is smaller than or equal to the preset value, it means that the difference between the two adjacent sub-pixel values is not large, it can be determined that is not the bright and dark image of a sub-pixel, that is, in the case of an image, the color shift compensation need to be initiated, in order to reduce the occurrence of color shift phenomenon, making the viewing experience of user to improved.

A fourth processing unit 206' is configured for initiating the color shift compensation if there is the one of the sub-pixel values in the current row storage space being different from the sub-pixel value in the previous row storage space corresponding to the sub-pixel value in the current row storage space.

Figure 6:
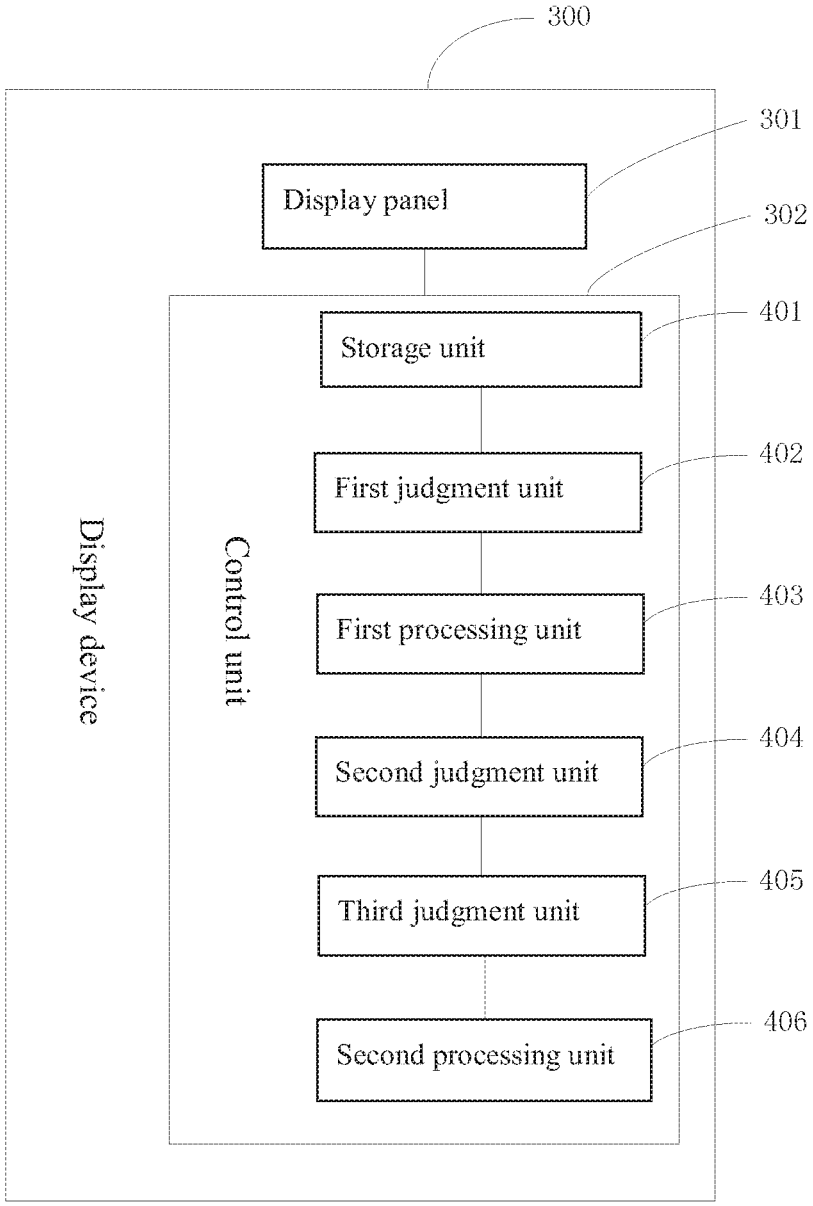
FIG. 6 is a schematic block diagram of a display device provided in an embodiment of the present application.

Referring to FIG. 6, FIG. 6 is a schematic block diagram of a display device provided in an embodiment of the present application. The display device 300 as shown in the figure can include a display panel 301 and a control unit 302, the control unit 302 includes:

A storage unit 401 is configured for storing inputted n numbers of sub-pixel values one by one in a row storage space, wherein n is an integer greater than or equal to four.

A first judgment unit 402 is configured for judging every spaced two of the sub-pixel values whether are the same or not.

A first processing unit 403 is configured for initiating a color shift compensation if there is the spaced two of the sub-pixel values being different from each other.

A second judging unit 404 is configured for judging every adjacent two of the sub-pixel values whether are different from each other if every spaced two of the sub-pixel values are the same.

A third judging unit 405 is configured for judging every one of the sub-pixel values in a current row storage space whether is different from a sub-pixel value in a previous row storage space corresponding to the sub-pixel value in the current row storage space if every adjacent two of the sub-pixel values are different from each other.

A second processing unit 406 is configured for doing not initiate a color shift compensation if every one of the sub-pixel values in the current row storage space is different from the sub-pixel value in the previous row storage space corresponding to the sub-pixel value in the current row storage space. row storage space.

Wherein, the display panel 301 can be, for example, a liquid crystal display panel, an OLED display panel, a QLED display panel, a curved display panel, or other type display panel, and is not specifically limited thereto.

Figure 7:
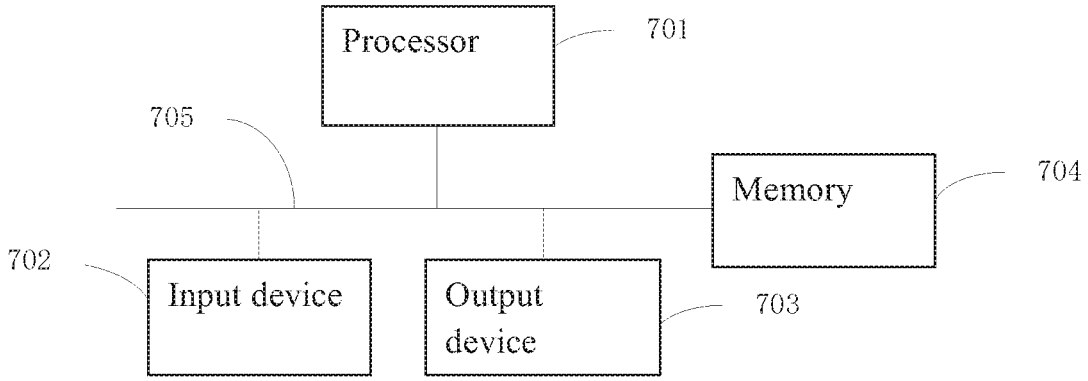
FIG. 7 is a schematic block diagram of a terminal provided in another embodiment of the present application.

Referring to FIG. 7, FIG. 7 is a schematic block diagram of a terminal provided in another embodiment of the present application. The terminals in the present embodiment as shown in the figure can include: one or more processors 701, one or more input devices 702, one or more output devices 703, and a memory 704. The above-described processor 701, the input device 702, the output device 703, and the memory 704 are connected via a bus 705. The memory 702 is used to store instructions, and the processor 701 is used to execute the instructions stored in the memory 702.

Wherein, the processor 701 is configured for storing inputted n numbers of sub-pixel values one by one in a row storage space, wherein n is an integer greater than or equal to four; for judging every spaced two of the sub-pixel values whether are the same or not; for judging every adjacent two of the sub-pixel values whether are different from each other if every spaced two of the sub-pixel values are the same; for judging every one of the sub-pixel values in a current row storage space whether is different from a sub-pixel value in a previous row storage space corresponding to the sub-pixel value in the current row storage space if every adjacent two of the sub-pixel values are different from each other.

The processor 701 can also be specifically used to obtain the absolute difference of two adjacent sub-pixel values by calculation, determine whether the absolute difference is greater than a preset value; if the absolute difference is greater than a preset value, the color shift compensation is not initiated.

It should be understood that, in the present application embodiment, the processor 701 can be a central processing unit (CPU), the processor can also be other general purpose processors, digital signal processors (DSPs), application specific integrated circuits (ASICs), field-programmable gate arrays (FPGAs) or other programmable logic devices, discrete gate or transistor logic devices, discrete hardware components, and the like. The general purpose processor can be a microprocessor or the processor can also be any conventional processor.

The input device 702 can include a touchpad, a fingerprint pick sensor (for collecting the fingerprint information of the user, and the direction information of the fingerprint), a microphone, and the like, and the output device 703 can include a display (LCD, etc.), a speaker, or the like.

The memory 704 can include a read-only memory and a random access memory and provide instructions and data to the processor 701. A portion of the memory 704 can also include a non-volatile random access memory. For example, the memory 704 can also store information about the device type.

In a specific implementation, the processor 701, the input device 702, and the output device 703 described in another embodiment of the present application can perform an embodiment of the method for color shift compensation based on an abnormal image detection provided by the embodiment of the present application and another embodiment, the implementation of the terminal described in the embodiments of the present application can be performed, and will not be described again.

In a particular implementation, the terminals described in another embodiment of the present application include, but are not limited to, other portable devices such as mobile phones, laptop computers, or tablet computers having touch-sensitive surfaces (e.g., touch screen displays and/or touch panels) equipment. It should also be understood that, in some embodiments, the device is not a portable communication device but a desktop computer having a touch-sensitive surface (e.g., a touch screen display and/or a touchpad).

Those of ordinary skill in the art will appreciate that the elements and algorithm steps of the various examples described in connection with the embodiments disclosed herein can be implemented in electronic hardware, computer software, or a combination of the two, in order to clearly illustrate the hardware and software Interchangeability, the composition and steps of each example have been described in terms of functionality in the above description. Whether these functions are implemented in hardware or software depends on the specific application and design constraints of the technical solution. The skilled artisan can use different methods to implement the described functions for each particular application, but such implementations should not be considered beyond the scope of the present application.

It will be apparent to those skilled in the art that, for the sake of convenience and simplicity of description, the corresponding processes of the described terminals and units described above can refer to the corresponding processes in the foregoing embodiment of the method and will not be described further herein.

In several embodiments provided herein, it should be understood that the disclosed terminals and methods can be implemented in other ways. For example, the embodiment of the device described above is merely illustrative, for example, the division of the cells is only a logical function division, and there can be additional ways of actually implementing, for example, multiple units or components can be combined or can be integrated into another system, or some feature can be ignored or not executed. In addition, the coupling or direct coupling or communication connection shown or discussed can be either an indirect coupling or a communication connection through some interfaces, devices or units, or can be electrically, mechanically, or otherwise connected.

The steps in the method of the present application can be sequentially adjusted, merged and deleted according to actual needs.

The units in the terminal of the embodiments of the present application can be combined, divided and deleted according to actual needs.

The units described as the separation means can or cannot be physically separate, and the components shown as units can or cannot be physical units, i.e., can be located in one place or can be distributed over a plurality of network elements. The part or all of the elements can be selected according to the actual needs to achieve the purpose of the embodiment of the present application.

In addition, the functional units in the various embodiments of the present application can be integrated in one processing unit, or each unit can be physically present, or two or more units can be integrated in one unit. The above-mentioned integrated unit can be implemented either in the form of hardware or in the form of software functional units.

The integrated unit can be stored in a computer-readable storage medium if it is implemented in the form of a software functional unit and sold or used as a separate product. Based on this understanding, the technical solution of the present application, either essentially or in part, contributes to the prior art, or all or part of the technical solution can be embodied in the form of a software product stored in a storage medium Includes a number of instructions for enabling a computer device (which can be a personal computer, a server, or a network device, etc.) to perform all or part of the steps described in the various embodiments of the present application. The aforementioned storage medium includes a variety of media such as a USB disk, a mobile hard disk, a read-only memory, a random access memory (RAM), a magnetic disk, or an optical disk.

Above are embodiments of the present application, which does not limit the scope of the present application. Any modifications, equivalent replacements or improvements within the spirit and principles of the embodiment described above should be covered by the protected scope of the invention.

What is claimed is:

1. A method for color shift compensation based on an abnormal image detection, comprising:

storing inputted n numbers of sub-pixel values one by one in a row storage space, wherein n is an integer greater than or equal to four;

judging every spaced two of the sub-pixel values whether are the same or not by comparing one of the every spaced two of the sub-pixel values with the other one of the every spaced two of the sub-pixel values;

initiating a color shift compensation if there is the spaced two of the sub-pixel values being different from each other;

judging every adjacent two of the sub-pixel values whether are different from each other if every spaced two of the sub-pixel values are the same by comparing one of the every adjacent two of the sub-pixel values with the other one of the every adjacent two of the sub-pixel values;

judging every one of the sub-pixel values in a current row storage space whether is different from a sub-pixel value in a previous row storage space corresponding to the sub-pixel value in the current row storage space if every adjacent two of the sub-pixel values are different from each other; and not initiating a color shift compensation if every one of the sub-pixel values in the current row storage space is different from the sub-pixel value in the previous row storage space corresponding to the sub-pixel value in the current row storage space.

2. The method according to claim 1, wherein the step of not initiating a color shift compensation if every one of the sub-pixel values in the current row storage space is different from the sub-pixel value in the previous row storage space corresponding to the sub-pixel value in the current row storage space comprises:

calculating an absolute difference value of two adjacent sub-pixel values respectively in the current row storage space and the previous row storage space;

judging the absolute difference value whether is greater than a preset value or not; and not initiating the color shift compensation if the absolute difference is greater than the preset value.

3. The method according to claim 2, further comprising:

initiating the color shift compensation if the absolute difference is smaller than or equal to the preset value.

4. The method of claim 2, further comprising:

initiating a color shift compensation if there is the adjacent two of the sub-pixel values being the same.

5. The method of claim 2, further comprising:

initiating the color shift compensation if there is the one of the sub-pixel values in the current row storage space being different from the sub-pixel value in the previous row storage space corresponding to the sub-pixel value in the current row storage space.

6. The method of claim 1, further comprising:

initiating a color shift compensation if there is the adjacent two of the sub-pixel values being the same.

7. The method of claim 1, further comprising:

initiating the color shift compensation if there is the one of the sub-pixel values in the current row storage space being different from the sub-pixel value in the previous row storage space corresponding to the sub-pixel value in the current row storage space.

* * * * *